United States Patent [19]

Hiraga

[11] 4,283,166

[45] Aug. 11, 1981

[54] FLUID SUCTION AND DISCHARGE APPARATUS

[75] Inventor: Masaharu Hiraga, Isesaki, Japan

[73] Assignee: Sankyo Electric Company, Limited, Isesaki, Japan

[21] Appl. No.: 5,917

[22] Filed: Jan. 23, 1979

[30] Foreign Application Priority Data

Jan. 24, 1978 [JP] Japan ..... 53-5800

[51] Int. Cl.[3] ..... F04B 1/12

[52] U.S. Cl. ..... 417/269

[58] Field of Search ..... 417/269

[56] References Cited

U.S. PATENT DOCUMENTS

| | | | |
|---|---|---|---|
| 3,215,341 | 11/1965 | Francis | 417/269 |
| 3,552,886 | 1/1971 | Olson, Jr. | 417/269 |
| 3,817,660 | 6/1974 | Knowles et al. | 417/269 |
| 4,011,029 | 3/1977 | Shimizu | 417/269 |

*Primary Examiner*—William L. Freeh

*Attorney, Agent, or Firm*—Hopgood, Calimafde, Kalil, Blaustein & Judlowe

[57] ABSTRACT

A single metal sheet suction reed valve member having a plurality of radial outwardly extending reeds which is held between a cylinder block having a plurality of axial cylinders in spaced annular relation and a valve plate together with a gasket, is formed with radial outwardly extending fingers between adjacent reeds. The end surface of the cylinder block is formed with a spot faced recess at the central region which connects all cylinders and which receives the suction reed valve member. The spot faced recess is formed with a radius greater than a distance from the center of the cylinder block to a point on an opening edge of one of the cylinders in symmetry with another point on the opening edge intersecting with a side edge of the corresponding reed in relation to an imaginary line connecting between the centers of adjacent cylinders. Each finger extends to the periphery of the spot faced recess and covers the bottom surface region of the recess between adjacent cylinders. Thus, the fluid leakage path between adjacent cylinders along the arcuate edge or the extending end of each finger is relatively long so that fluid leakage may be substantially prevented.

Each finger may be formed sufficiently wide so as to extend to adjacent reeds and to overlap adjacent cylinders. Thus, the reexpanding volume of the fluid in each cylinder is reduced.

3 Claims, 13 Drawing Figures

FLUID SUCTION AND DISCHARGE APPARATUS

BACKGROUND OF THE INVENTION

This invention relates to fluid suction and discharge apparatus including a cylinder block having a plurality of cylinders and pistons slidably reciprocated in the cylinders, for example fluid compressors, and, in particular, to improvements of the seal between adjacent cylinders in such apparatus.

In U.S. Pat. No. 4,011,029, a fluid compressor is disclosed wherein a single sheet of suction reed valve means of a metal sheet comprising a central portion and a plurality of radially outwardly extending reeds is used. The cylinder block is formed with a central spot faced recess on an end surface for the accomodation of the suction reed valve means. A gasket is held between the suction reed valve means and the cylinder block. Thus, the seal between the cylinder block and the valve plate is achieved without the use of a housing to contain the cylinder block and many O-rings so that the volume of the compressor may be reduced.

In the construction disclosed in the prior patent, a narrow gap exists between the peripheral end surface of the central portion of the suction reed valve means and the bent portion of the gasket along the step of the center recess, which communicates between adjacent cylinders.

On the other hand, each reed does not extend to cover the entire sectional area of the corresponding cylinder. Therefore, when the piston reaches the top dead position at the end of the compressing operation, a small part of the fluid is retained in spaces at both sides of the reed between the piston top surface and the valve plate. The retained fluid reexpands in the cylinder at the following suction operation, which results in to a lower volumetric efficiency of the compressor.

SUMMARY OF THE INVENTION

A general object of this invention is to provide a compressor which is compact, simple in the construction, has a reliable seal between the cylinder block and the valve plate, and little fluid leakage between cylinders.

Another object of this invention is to provide an improved construction for the fluid suction and discharge apparatus shown in U.S. Pat. No. 4,011,029.

Still another object of this invention is to provide a fluid suction and discharge apparatus in which the reexpanding volume of compressed fluid in each cylinder is substantially reduced, without complicating the producing processes.

According to this invention, a fluid suction and discharge apparatus is provided which comprises a cylinder block formed with a plurality of cylinders parallel to one another and in spaced annular relation around a center axis thereof. The cylinder block is formed with a spot faced recess in one end surface thereof, the central region of which connects all the cylinders. Pistons are slidably reciprocated in the cylinders for fluid suction and discharge. A valve plate is secured to the cylinder block at the end thereof with inlet and outlet openings in registry with each of the cylinders. A discharge valve means is secured to the valve plate. A suction reed valve means is formed from a metal sheet having a smaller diameter than that of the valve plate and comprises a central portion and a plurality of suction reeds extending radially outwardly from the central portion.

The number of reeds corresponds to the number of cylinders. The suction reed valve means is contained with in the recess and is held between the cylinder block and the valve plate. A gasket of similar configuration as the valve plate is placed between, and is in contact with, the cylinder block and the valve plate at the peripheral portion thereof, and the cylinder block and the suction reed valve means at the central portion thereof. The spot faced recess is formed with a radius greater than the distance from the center of the cylinder block to a point on an outer edge of one of the cylinders in symmetry with another point on the outer edge intersecting with a side edge of a corresponding one of the reeds in relation to an imaginary line connecting between the centers of adjacent cylinders, but less than the sum of the distance from the center of the cylinder block to the center of each cylinder and the radius of each cylinder. The suction reed valve means is formed with a plurality of radial fingers, each of which extends radially outwardly from the central portion to the peripheral edge of the spot faced recess between adjacent reeds covering the cylinder block end surface region between adjacent cylinders.

Each of the fingers may be formed sufficiently wide so as to extend to adjacent reeds and to overlap adjacent cylinders and fill the dead space between the top surface of the piston and the surface of the valve plate so that the fluid reexpanding volume in each cylinder may be reduced.

Further objects, features and other aspects of this invention will be understood from the following description of preferred embodiments of this invention with reference to the annexed drawings.

DETAILED DESCRIPTION OF PREFERRED EMBODIMENTS

Figure 1:
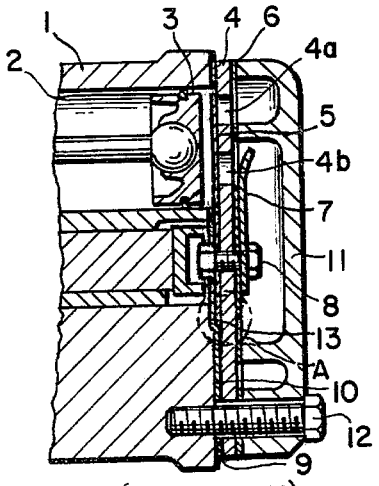
(PRIOR ART) FIG. 1
FIG. 1 is a cross-sectional view of a portion of a known compressor.
Figure 3:
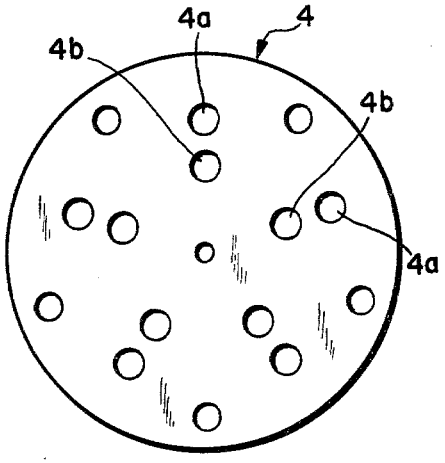
(PRIOR ART) FIG. 3
FIG. 3 is a plan view of the valve plate used in the compressor of FIG. 1.
Figure 2:
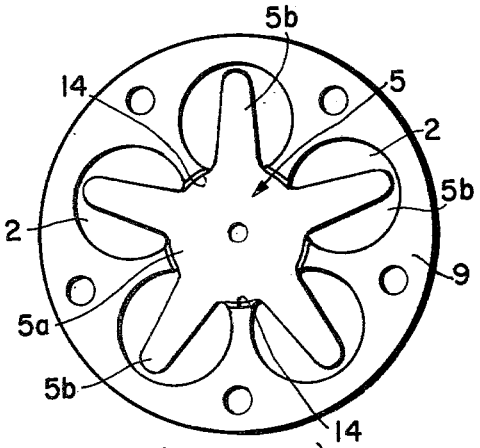
(PRIOR ART) FIG. 2
FIG. 2 is an end view of the compressor in FIG. 1 with the valve plate, discharge reed valve means and cylinder head removed.

Referring to FIGS. 1, 2, and 3, there is shown the known compressor including a fluid suction and discharge apparatus as disclosed in U.S. Pat. No. 4,011,029. The compressor comprises a cylinder block 1 having a plurality of axially oriented cylinders 2 formed therein parallel to one another and in spaced annular relation around the central axis thereof. In each cylinder 2, a piston 3 is slidably fitted and is reciprocated by any suitable means. A valve plate 4, which may be of circular shape and formed with inlet and outlet openings 4*a* and 4*b* in registry with each cylinder 2 is secured to the cylinder block 1 at one end thereof. Between cylinder block 1 and valve plate 4, a single sheet of suction reed valve means 5 and a sheet of gasket 9 is inserted and held. Suction reed valve means 5 comprises a central portion 5*a* corresponding to the central region of the end surface of cylinder block 1 surrounded by a plurality of, for example, five cylinders, and five reeds 5*b* radially extending therefrom. Gasket 9 is of a similar circular shape as valve plate 4 and is formed with holes in registry with cylinders 2 of cylinder block 1. The end surface 10 of cylinder block 1 is formed with a spot faced recess 13 at the central region thereof which connects with all the cylinders. The recess 13 is to accommodate suction reed valve means 5 and, therefore, is formed in correspondance to the shape and thickness of suction reed valve means 5. On the opposite surface of valve plate 4, discharge reed valve means 6 and stopper plate 7 are mounted and secured to valve plate 4 by means of a bolt 8. To valve plate 4, a cylinder head 11 is mounted which is formed with a suction chamber and a discharge chamber in registry with inlet openings 4*a* and outlet openings 4*b* of valve plate 4 respectively. Valve plate 4 and cylinder head 11 are mounted on, and secured by bolts 12 to cylinder block 1. Gasket 9 is inserted between cylinder block 1 and valve plate 4 and suction reed valve means 5 is inserted between gasket 9 and valve plate 4.

A fluid, such as a refrigerant gas, in response to the reciprocation of pistons 3, is introduced in cylinders 2 from the suction chamber and discharged therefrom to the discharge chamber. Thus, the gas is circulated in the refrigerant system (not shown) connected to the suction and discharge chambers.

Figure 4:
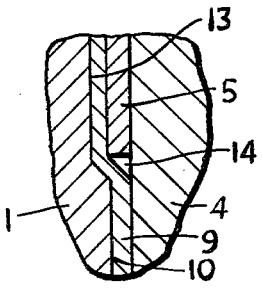
(PRIOR ART) FIG. 4
FIG. 4 is an enlarged sectional view of a portion indicated by A in FIG. 1.

In this construction, the seal between the cylinder block and the valve plate is achieved by only the use of gasket 9. But a narrow gap 14, as shown in FIGS. 2 and 4, exists between the peripheral end surface of the central portion 5*a* of the bent portion of suction reed valve means 5 and gasket 9, along the step of the center recess and communicates between adjacent cylinders. Some of the fluid leaks from one cylinder to adjacent cylinders through gaps 14. This leakage is so little that the efficiency of the compressor may not be degraded, but leakage is not desirable.

On the other hand, since each reed 5*b* does not extend over the entire sectional area of the corresponding cylinder 2, a space is maintained between the top surface of piston 2 and valve plate 4 around the reed when the piston reaches the top dead position at the end of the compressing operation. Therefore, a small part of the fluid is not discharged and remains in the cylinder after the fluid discharge operation, and is reexpanded in the cylinder during the following fluid suction operation, which degrades the volumetric efficiency of the compressor.

Referring to FIGS. 5–8, an embodiment of this invention is shown which is similar to the known compressor of FIGS. 1–4, except that the configuration of the spot faced recess in the cylinder block and the configuration of the suction reed valve means are different. Accordingly, similar parts in FIGS. 5–8 are represented by the same reference numerals as in FIGS. 1–4 and the description of the similar parts will be omitted for purposes of simplification.

Figure 7:
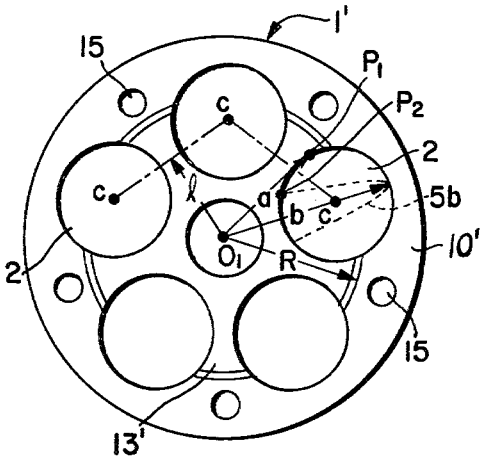
FIG. 7 is an end view of the cylinder block of the compressor of FIG. 5.

In the embodiment shown, the recess 13' in end surface 10' of the cylinder block 1' is formed by spot facing with a radius R sufficiently greater than the distance l from the center $O_1$ of the cylinder block 1' to an imaginary line connected between centers c—c of adjacent cylinders 2. Strictly stated, radius R is determined greater than a distance a from the center $O_1$ of cylinder block 1' to a point $P_1$ on the outer edge of each cylinder 2 in symmetry with another point $P_2$ on the outer edge which intersects a side edge of corresponding reed 5*b* in relation to the imaginary line connecting between centers c—c of the cylinder and the adjacent cylinder, as shown in FIG. 7. But radius R must be shorter than length b which is the sum of the distance from the center $O_1$ of the cylinder block 1' to the center c of each cylinder 2 and the radius of each cylinder. If tapped holes 15 for receiving bolts 12 are formed in the surface region within an imaginary circle of the radius b, as in the embodiment shown, the radius R must be shorter than a distance from the center $O_1$ of the cylinder block 1' to each tapped hole 15.

The depth of the spot faced recess 13' is set equal to the thickness of the suction reed valve means 5'.

Figure 8:
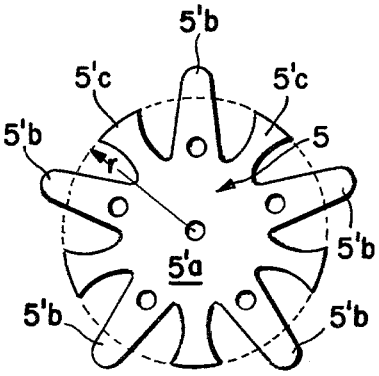
FIG. 8 is a plan view of a suction reed valve means used in the compressor shown in FIG. 5.

The suction reed valve means 5' is formed of a single sheet of metal and comprises a central portion 5'*a* and five reeds 5'*b* extending radially outwardly from the central portion, similar to the suction reed valve means in the known compressor. The suction reed valve means 5' is further provided with five fingers 5'*c* extending radially outwardly from the central portion 5'*a* between adjacent two reeds 5'*b*, as shown in FIG. 8.

The extended end of each finger 5'*c* is formed in an arcuate shape or in a part of a circle (as shown by a broken line) of a radius r about the center of suction reed valve means 5'. The radius r is approximately equal to, but shorter than, the radius R of the recess 13' by about the thickness of the gasket 9. Thus, suction reed valve means 5' is able to be accomodated in the recess 13' with each reed 5'*b* projecting over the corresponding cylinder 2 and with each finger 5'*c* lying on, and covering, the bottom surface region of the recess 13' between adjacent cylinders. The extended end of each finger 5'*c* generally reaches the periphery of recess 13'. Both side edges of each finger 5'*c* are arcuate to conform with the opening edge of each cylinder 2.

Figure 6:
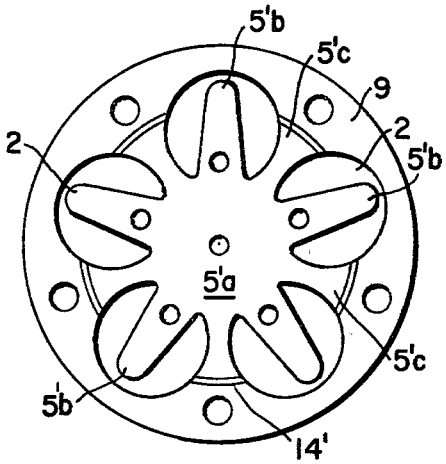
FIG. 6 is an end view of the compressor in FIG. 5 with the valve plate, discharge reed valve means and cylinder head removed.

In assembling the compressor, gasket 9 is laid on the end surface 10' of cylinder block 1', and, then, suction reed valve means 5' is overlaid on the gasket 9, as shown in FIG. 6. Thereafter, valve plate 4 and cylinder head 11 are mounted on, and secured by bolts means 12 to cylinder block 1'. Alternatively, gasket 9 and suction reed valve means 5' are supported to valve plate 4 by bolt 8 which secures discharge valve means 6 and stopper plate 7 to valve plate 4. Thereafter, valve plate 4 and cylinder head 11 are mounted on, and secured to, cylinder block 1'.

In this arrangement, the seal between the cylinder block 1' and the valve plate 4 is achieved similar to the known construction as disclosed in U.S. Pat. No. 4,011,029. Although a narrow gap 14' exists between the gasket 9 and the extending end of each finger 5'c, the length of the narrow gap is longer than of gap 14 in the known compressor disclosed in FIGS. 1–4. Therefore, the fluid flow resistance through narrow gap 14' is sufficiently higher in comparison with the known arrangement so that leakage through narrow gap 14' may be substantially prevented. Accordingly, seal between adjacent cylinders can be achieved.

Although the length of the narrow gap between the peripheral end of the central portion of the suction reed valve means and the gasket may be made longer in comparison to the known arrangement by making the radius of the spot faced recess and the central portion of the suction reed valve means smaller in comparison with the known arrangement, it should be noted that the width of each reed must therefore also be made smaller. In certain cases, the recess accomodating the suction reed valve means can not be formed by the spot facing alone, and the end surface of the cylinder block must be additionally machined to form radial recesses extending from the spot faced recess to respective cylinders. This results in production complications for the compressor.

Figure 5:
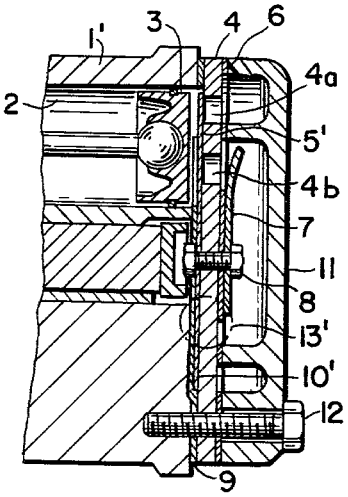
FIG. 5 is a sectional view of a portion of a compressor according to one embodiment of this invention.
Figure 9:
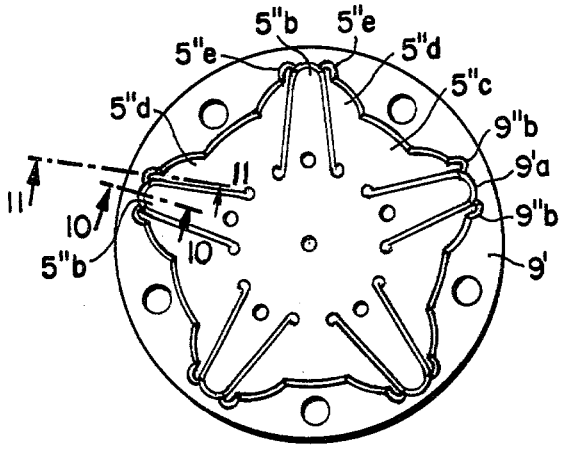
FIG. 9 is an end view of a compressor of another embodiment according to this invention with the valve plate, discharge reed valve means and cylinder head removed.
Figure 11:
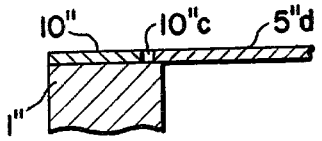
FIG. 11 is a sectional view along line 11—11 in FIG. 9.
Figure 12:
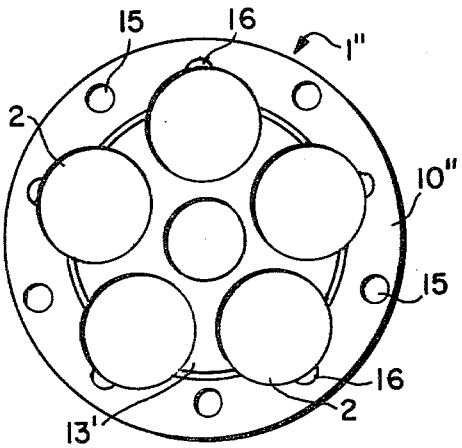
FIG. 12 is an end view of the cylinder block used in the compressor shown in FIG. 9.
Figure 13:
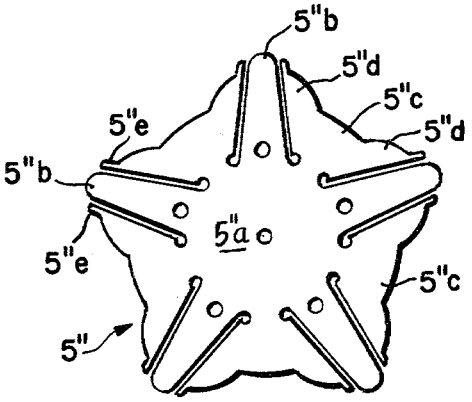
FIG. 13 is a plan view of a suction reed valve means used in the compressor shown in FIG. 9.

In another aspect of this invention, each finger of the suction reed valve means is modified as shown in FIGS. 9–13. In the embodiment shown, a similar spot faced recess 13' as of the embodiment in FIGS. 5–7 is formed in the end surface 10'' of the cylinder block 1''. The suction reed valve means 5'' is also formed of a sheet from metal and comprises a central portion 5''a, five reeds 5''b, and five fingers 5''c, as shown in FIG. 13. Each reed 5''b is longer than those of the embodiment shown in FIGS. 5–8, so that the extended end thereof may reach the outer edge of the corresponding cylinder 2. Each finger 5''c has wing portions 5''d which extend oppositely from both sides of the finger to adjacent reeds 5''b overlapping adjacent cylinders to fill any open spaces. Each wing portion 5''d is formed with a projection 5''e. The peripheral edge of each wing portion 5''d comprises a portion extending adjacent to, and along, reed 5''b and the other edge is arcuate to conform to the outer edge of the cylinder, as shown in FIGS. 9 and 13.

Figure 10:
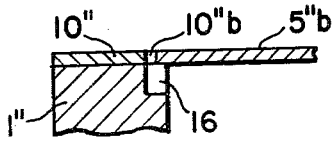
FIG. 10 is a sectional view along line 10—10 in FIG. 9.

At the outer edge of each cylinder 2, a cut-away portion or a depression 16 is formed for receiving the extended end of the corresponding reed 5''b, as shown in FIGS. 10 and 12, so that the reed may be elastically deformed in operation in an assembled state.

The gasket 9' is also formed with cut-away portions 9'a corresponding to depressions 16, and another cut-away portions 9'b for receiving radial projections 5''e of suction reed valve means 5''.

When the gasket 9' and the suction reed valve means 5'' are assembled onto the end surface of cylinder block 1'', the suction reed valve means 5'' is contained within recess 13'' with gasket 9' being held between suction reed valve means 5'' and the cylinder block 1'', as shown in FIG. 9. The extended end of each reed 5''b is received in a corresponding depression 16 so that reed 5''b may be permitted to deform in the fluid suction operation. On the other hand, the projection 5''e of each finger 5''c is in contact with the end surface 10'' of the cylinder block as shown in FIG. 11, and, therefore, is held between the cylinder block 1'' and the valve plate 4. So that the wing portions which overlap adjacent cylinder openings can be maintained against movement during compressor operation.

In this arrangement, since not only the reed 5''b but also two wing portions 5''d overlap the opening of each cylinder 2, the less space is formed between the piston and the valve plate when the piston 3 reaches the top dead position, so that the fluid reexpansion volume in each cylinder may be reduced in comparison with the embodiment FIGS. 5–8 and the known construction of FIGS. 1–4.

The depth of the depression 16 is set so as to permit the reeds to be elastically deformed for the suction operation but to prevent the reed from being excessively deformed. Therefore, in the embodiment, damage of the reed due to the excessive deformation is prevented, with the advantage of reduced fluid reexpansion volume in each cylinder. However, since the provision of depression 16 results to the increase of the fluid reexpanding volume in the cylinder, the smaller the volume of depression 16 is, the better the reduction fluid reexpansion volume. In certain cases, the provision of the depression 16 is omitted with the length of the reed shortened similarly to that of FIGS. 5–8.

This invention has been described in detail in connection with preferred embodiments, but these are for example only and this invention is not restricted thereto. It will be easily understood by those skilled in the art that the variations and modifications can be easily made without departing from the scope of this invention.

What is claimed is:

1. In a fluid suction and discharge apparatus including a cylinder block formed with a plurality of cylinders in parallel with one another and in spaced annular relation around a center axis thereof, said cylinder block being formed with a spot faced recess in one end surface thereof at the central region which connects all cylinders, pistons slidably reciprocable in said cylinders for fluid suction and discharge, a valve plate secured to said cylinder block at the end thereof with inlet and outlet openings in registry with each of said cylinders, discharge valve means, a sheet of suction reed valve formed from a metal sheet having a smaller diameter than said valve plate and comprising a central portion and a plurality of suction reeds extending radially outwardly therefrom corresponding to respective said cylinders, said suction reed valve means being received in said recess and held between said cylinder block and said valve plate, and a gasket of similar extent as said valve plate being placed between, and being in contact with, said cylinder block and said valve plate at the peripheral portion thereof, and said cylinder block and said suction reed valve means at the central portion thereof, the improvement comprising: said suction reeds intersecting the outer periphery of said cylinders at a point $P_2$, the center of each cylinder being at a point c, a line c—c extending between said cylinders, the center of said cylinder block being at a point $O_1$, a point $P_1$ being defined as a point on the outer periphery of said cylinder symmetrical about line c—c on the other side thereof, the radius of said spot faced recess being R, wherein $a<R<b$ in which a is the distance between points $O_1$ and $P_1$ and b is the distance between $O_1$ and c plus the radius of said cylinder, and said suction reed valve means being formed with a plurality of radial fingers each of which extends radially outwardly from said central portion to the peripheral edge of said spot faced recess between adjacent two reeds covering said cylinder block end surface region between adjacent cylinders.

2. The improvement as claimed in claim 1, wherein each of said fingers is provided with wing portions at both sides thereof which extend oppositely to adjacent reeds and overlap adjacent cylinders, each of said wing portions being provided with a radial projection, and said gasket being formed with cut-away portions for receiving said projections whereby each projection may be directly held between said cylinder block and said valve plate.

3. The improvement as claimed in claim 2, wherein each of said reeds is formed with a length so that the end thereof may reach beyond the outer edge of the corresponding cylinder, said cylinder block being formed with depressions on the outer edges of said cylinders for receiving said ends of said reeds, and said gasket being formed with cut-away portions corresponding to said depressions for receiving said ends of said reeds.

* * * * *